United States Patent [19]

Hann

[11] 4,149,963

[45] Apr. 17, 1979

[54] CONTROL OF AFTERBURNING IN CATALYTIC CRACKING

[75] Inventor: Paul D. Hann, Bartlesville, Okla.

[73] Assignee: Phillips Petroleum Company, Bartlesville, Okla.

[21] Appl. No.: 837,129

[22] Filed: Sep. 28, 1977

[51] Int. Cl.[2] ..... C10G 11/18

[52] U.S. Cl. ..... 208/150; 208/164; 208/DIG. 1

[58] Field of Search ..... 208/164, DIG. 1, 150

[56] References Cited

U.S. PATENT DOCUMENTS

| | | | |
|---|---|---|---|
| 3,004,926 | 10/1961 | Goering | 252/417 |
| 3,161,583 | 12/1964 | Pohlenz | 208/164 |
| 3,316,170 | 4/1967 | Stewart et al. | 208/164 |
| 3,769,203 | 10/1973 | Lee et al. | 208/164 |

*Primary Examiner*—Herbert Levin

[57] ABSTRACT

By manipulating the degree of stripping of the used or spent catalyst leaving the cracker, the afterburning in a regenerator is controlled both efficiently and rapidly.

5 Claims, 1 Drawing Figure

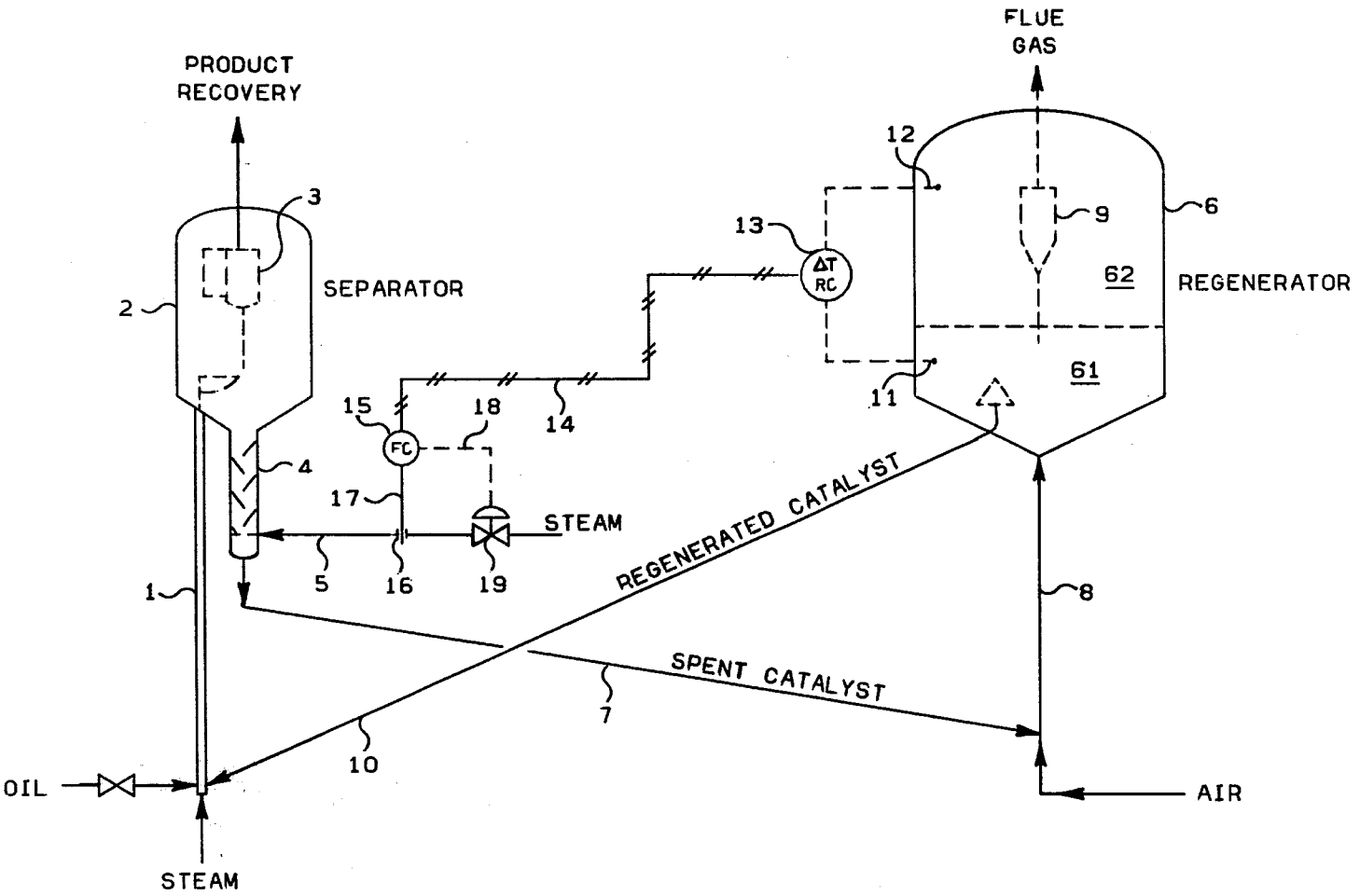
FLUE GAS
REGENERATOR
6
9
62
61
12
11
13
ΔT RC
8
AIR
REGENERATED CATALYST
SPENT CATALYST
7
14
STEAM
18
19
FC
15
16
17
5
10
SEPARATOR
PRODUCT RECOVERY
3
4
2
1
STEAM
OIL

CONTROL OF AFTERBURNING IN CATALYTIC CRACKING

The present invention relates to the catalytic cracking of hydrocarbons. More specifically, the present invention relates to the problem of after burning in regenerators.

BACKGROUND OF THE INVENTION

Catalytic cracking is a widely used process for conversion of relatively heavy hydrocarbons to lighter components. This process is particularly useful for the conversion of gas oil, topped crude, and the like, into components boiling primarily in the gasoline boiling range. For the catalytic cracking process, fluidized catalysts, generally silica based catalysts, are used. These catalysts may contain some material of the zeolitic structure or other additives and components. After the cracking catalyst has been used in the reactor, the coke formed on the catalyst is burned off generally in a separate regenerator and in a fluidized bed operation. In this regeneration, the catalyst activity is restored.

In the catalyst regenerator, the so-called "afterburning" constitutes a common and well known problem. This afterburning is caused by the presence of enough oxygen in the dilute phase of the regenerator to combust carbon monoxide, a product of the incomplete combustion taking place in the dense phase of the regenerator located below the dilute phase. This afterburning in the dilute phase is very undesirable because (1) very high temperatures can be caused by the afterburning, which in turn can cause damage to the cyclones, the vessel itself and the related equipment, (2) elevated temperatures can damage the catalyst, (3) the excess heat of the afterburning is not likely to be recovered and (4) the afterburning constitutes a safety hazard.

For controlling the afterburning, it has been suggested in the prior art to adjust the regeneration air rate. This procedure is rather involved because the air for the regenerator is normally provided from a large air blower that is ideally operated at constant, full speed and cannot readily be controlled. Further, operation of the air blower at less than full capacity is a waste which could be utilized in obtaining greater feed throughput, higher conversion and/or greater selectivity by better catalyst regeneration or higher circulation rates. Other methods for controlling the afterburning include adjusting the catalyst circulation rate, the oil feed rate and the injection of an external gas into the regenerator. These methods are not entirely satisfactory because they are either slow in response, result in lower conversion or lower production rates or are expensive.

THE INVENTION

It is thus one object of this invention to provide an improved catalytic cracking process.

Another object of this invention is to provide a method for controlling the afterburning in a catalytic cracking catalyst regenerator.

A further object of this invention is to control the afterburning in a catalyst regenerator in a fast and efficient manner.

These and other objects, advantages, details, embodiments and features of this invention will become apparent to those skilled in the art from the following detailed description of the invention, the appended claims and the drawing, which schematically shows a catalytic cracking operation with the control system of this present invention.

In accordance with this invention, there is now provided a process for controlling the afterburning in a catalytic cracking catalyst regenerator in which the degree of afterburning is determined and responsive to a respective signal wherein the flow of stripping gas which is used for stripping hydrocarbons from the spent cracking catalyst before it leaves the cracking zone and is transported to the regeneration zone is controlled. In accordance with this invention, the flow of stripping gas is decreased when the degree of afterburning is above a desired level and correspondingly the flow of stripping gases increased when the degree of afterburning is below a desired level.

More specifically, the present invention resides in a process for catalytic cracking of hydrocarbons wherein hydrocarbons are contacted in a cracking zone with a cracking catalyst under cracking conditions to produce a cracked hydrocarbon effluent stream and wherein used cracking catalyst is stripped with a stripping gas for removing hydrocarbons from the cracking catalyst and wherein the stripped cracking catalyst containing coke deposits is then transferred to a regeneration zone in which the cracking catalyst in a dense phase is contacted with a free oxygen containing gas to produce a regenerated catalyst to remove a substantial amount of the coke by combustion, and in which regenerator off-gas is removed from a dilute phase above the dense phase, wherein regenerated catalyst now at lower coke content and higher temperature is transferred to the cracking zone for cracking said hydrocarbon. In accordance with this invention, the degree of afterburning in the dilute phase is determined and a corresponding control signal is generated responsive thereto; then the flow of the stripping gas is manipulated responsive to the control signal as described above to decrease the flow of stripping gas when the degree of afterburning is above the desired level and/or to increase the flow of stripping gas when the degree of afterburning is below a desired level.

The invention thus makes possible to sense excess afterburning in the dilute phase of the regenerator; to rapidly stop this afterburning by decreasing the amount of flow of stripping fluid used to strip the occluded oil from the spent catalyst, leaving considerable oil on the spent catalyst charged from the reactor to the regenerator; to then, at the same time or subsequently, decrease the rate of flow of feed oil charged to the reactor, which manipulation, ultimately, but very slowly, brings the operation to a condition where no excess afterburning occurs; and then bring the flow rate of stripping fluid back up to the original quantity, now with no excess afterburning occurring at the new oil rate.

The cracking and regeneration process, as well as the apparatus utilized therein, are well known in the art and a detailed description thereof can therefore be avoided. Details of this process are described, for instance, in U.S. Pat. No. 3,492,221; Oil and Gas Journal, Nov. 23, 1970, pp. 72–78; U.S. Pat. Nos. 3,004,926; 3,629,097; and 3,161,583. The cracking catalyst involved is generally one that is capable of cracking heavy hydrocarbons under cracking conditions. Specifically and preferably, this catalyst is one that is capable of cracking hydrocarbons in the absence of added hydrogen.

The oils that are used as feedstock in this cracking operation are generally to be characterized as higher boiling hydrocarbons, particularly such oils as gas oils, virgin gas oils, and topped crude oils, and the like. The initial boiling point of these feedstocks preferably will be in the range of 500° to 650° F., or even higher.

The process condition for the cracking operation will be generally in the following ranges:

Cracking Conditions

Temperature: 700° F. to 1050° F.

Pressure: 10 psia to 70 psia

Correspondingly, the conditions in the regeneration zone are as follows:

Regeneration Conditions

Temperature: 900° F. to 1300° F.

Pressure: 10 psia to 70 psia

The desired degree of afterburning in the fluidized bed regenerator will be readily characterized by the temperature difference between the temperature of the dense phase and the dilute phase. Normally, a slight amount of afterburning is desired, with a temperature difference of up to about 20 F. degrees. Excess afterburning exists when this differential temperature is greater than about 20 F. Degrees, and a maximum is usually at above 40 F. or 50 F. degrees.

The free oxygen containing gas utilized for the regeneration can be oxygen, oxygen-enriched air or air, the latter being preferred.

The degree of afterburning in the regenerator can be determined in various ways. The preferred way of determining the degree of afterburning is to measure the difference between the temperatures in the dilute phase and in the dense phase of the regenerator. This temperature measurement, as well as the generation of a control signal corresponding to a temperature difference, is done in commercially available equipment.

Various gases can be used for the purpose of stripping the hydrocarbons from the catalyst before this catalyst is introduced into the regeneration zone. The preferred stripping gas is steam.

In accordance with this invention, it is possible to keep the flow rate of the free oxygen containing gas that achieves the regeneration of the catalyst at a constant rate whereas the degree of afterburning is controlled by manipulating the flow of the stripping gas so that the amount of combustible materials (coke and nonstripped hydrocarbon) that is carried by the catalyst from the cracker to the regenerator is manipulated in order to control the degree of afterburning. Preferably, excess afterburning is stopped by decreasing the amount of stripping steam used to strip "occluded" hydrocarbons from the coke-containing spent catalyst. This gives an almost immediate stopping of afterburning. Then conventional ways, e.g. oil decrease, can be used to ultimately (several hours' time) bring the system to operate with no excessive afterburning.

The invention will be still more fully understood from the following description of the drawing. Oil, steam and regenerated catalyst are contacted in a riser reactor 1 under cracking conditions. In the separator 2 on top of the riser, the catalyst and the cracked hydrocarbons are separated. The cracked hydrocarbons are removed from the separator via a cyclone 3. The used cracking catalyst moves through a spent catalyst stripping zone 4 where it is contacted with steam introduced via line 5 at the lower end of the spent catalyst stripping zone 4. The stripped, spent catalyst is then transferred to the regenerator 6 via lines 7 and 8. The spent catalyst is contacted with air under regeneration conditions so that at least a significant portion of the coke on the catalyst and those hydrocarbons that have not been stripped from the catalyst in the stripping zone 4 are combusted in the dense phase 61 of the regenerator 6. Flue gas produced during this combustion is removed from the dilute phase 62 of the regenerator 6 via a cyclone 9. Regenerated catalyst is transferred back from the regenerator 6 via line 10 and the cycle described is repeated. This is a continuous operation.

In the control process of this invention, the temperature of the dense bed 61 is measured by a temperature sensing means 11, whereas the temperature in the dilute phase 62 is measured by a temperature sensing means 12. These temperature sensing means can, for instance, be thermocouples. The two thermocouples 11 and 12 are connected via a temperature difference signal generator 13, which furnishes a signal representative of the difference between the temperatures of the dilute phase and the dense phase via line 14 to a flow controller 15. This flow controller receives a temperature difference control signal via line 14 and receives a signal representative of the actual flow of steam that is determined, e.g. by means of an orifice meter 16 via line 17. Flow controller 15 generates a control signal responsive to these two signals from lines 14 and 17, which is transferred via line 18 to manipulate the steam flow control valve 19. The control logic is such that in case the afterburning is high, i.e. in case the temperature difference signal generated by the temperature difference signal generator 13 is a large signal, the flow of steam is decreased to decrease the stripping and increase the hydrocarbon quantity on the spent catalyst transferred via line 7 into the regenerator. Correspondingly, when the afterburning is low, the temperature difference is small and the signal on line 14 is small, the degree of stripping is increased.

As an example, the signal generated by the unit 13 on line 14 can be such that the steam valve remains unchanged when the temperature difference is 50 F.° (28 C.°). Then if the regenerator temperature difference rises above this value, the flow rate of stripping steam is reduced thereby allowing more entrained and occluded hydrocarbon vapor to remain with the spent catalyst passing to the regenerator. This entrained hydrocarbon is very quickly burned in the dense phase, raising the temperature of the dense phase slightly and reducing the concentration of oxygen passing to the dilute phase. It is this free oxygen present in the dilute phase that burns the CO in the gas in this dilute phase to $CO_2$, generating excessive heat since the amount of catalyst in the dilute phase gas is so small that excessive heat is transferred to the gas, and the metal parts of the regeneration vessel, cyclone, etc., which heat can not be tolerated. Since the oxygen is now substantially completely consumed in the dense bed by burning this entrained and occluded oil on the spent catalyst, very little conversion of CO to $CO_2$ can occur in this dilute phase, thereby lowering the temperature in dilute phase. Thereby, the afterburning is reduced and the temperature difference is reduced correspondingly.

With this improved technique of this invention for controlling the afterburner, it is possible to maintain the operation of the regenerator at a maximum regeneration air rate and at maximum catalyst circulation rate while regulating oil feed rate to obtain the desired conversion in the catalytic cracker and regulating the stripping to maintain the desired level of afterburning. The invention does provide means for bringing an afterburning condition that is above the desired level under control rapidly. When conditions warrant, following or during the application of the teaching of the invention, conventional methods which require more time to be effective may be used such as adjusting catalyst level of circulation rate, oil rate or regeneration air rate.

The following calculated example is intended to illustrate how the embodiment of this invention demonstrates the utility of the invention without undue limitation of the scope thereof. In the attached table, column I presents the normal operation conditions for a gas oil cracker and the associated regenerator. Column II gives the conditions for an upset condition in which the regenerator temperature difference between the dilute phase and the dense phase rises from 25° to 50° F. In column III, the stripping steam rate is lowered by 80 percent. Within minutes the dilute phase temperature declines 30° F. Column IV illustrates the conditions sometime later when the oil feed rate has dropped slightly and stripping steam returns to a more normal rate. The temperature difference between the dilute phase and the dense bed of the regenerator is again back to the normal level.

Table

| | I | II | III | IV |
|---|---|---|---|---|
| Reactor: | | | | |
| Catalyst Circulation, Tons/Hr. (Metric Tons/hr.) | 300 (272) | 300 (272) | 300 (272) | 300 (272) |
| Gas Oil Feed (27 API), BBl/hr. (kg./hr.) | 350 (49.5) | 350 (49.5) | 350 (49.5) | 335 (47.4) |
| Pressure, psig., (MPa) | 15 (0.103) | 15 (0.103) | 15 (0.103) | 15 (0.103) |
| Temperature, ° F., (° C.) | 920 (493) | 920 (493) | 920 (493) | 930 (499) |
| Wt. % Carbon on "Spent" Catalyst, | 1.50 | 1.50 | 1.50 | 1.55 |
| Occluded Hydrocarbon on Spend Catalyst | | | | |
| Before Steam Stripping, Lb/hr. (kg/hr.) | 1000 (454) | 1000 (454) | 1000 (454) | 1000 (454) |
| After Steam Stripping, Lb/hr. (kg/hr.) | 10 (4.5) | 10 (4.5) | 700 (318) | 10 (4.5) |
| Stripping Steam (300° F.), Lb/hr. (kg/hr.) | 1000 | 1000 | 200 | 1000 |
| Catalyst to Oil Wt. Ratio, | 5.5:1 | 5.5:1 | 5.5:1 | 5.7:1 |
| Regenerator: | | | | |
| Catalyst Circulation, Tons/Hr. (Metric Tons/hr.) | 300 (272) | 300 (272) | 300 (272) | 300 (272) |
| Regeneration Air, MSCF/Hr. ($m^3S$) | 1600 (12.6) | 1600 (12.6) | 1600 (12.6) | 1600 (12.6) |
| Pressure, psig. (MPa) | 15 (0.103) | 15 (0.103) | 15 (0.103) | 15 (0.103) |
| Temperature, ° F., | | | | |
| Dense Phase | 1200 (649) | 1200 (649) | 1203 (651) | 1210 (655) |
| Dilute Phase | 1225 (664) | 1250 (676) | 1220 (660) | 1235 (670) |
| ΔT, F.°, (C.°) | 25 (14) | 50 (28) | 20 (11) | 25 (14) |
| Wt. % Carbon on Regen. Cat., | 0.100 | 0.100 | 0.100 | 0.105 |

Reasonable variations and modifications which will become apparent to those skilled in the art can be made in this invention without departing from the spirit and scope thereof.

I claim:

1. In a process for catalytic cracking of hydrocarbons wherein hydrocarbons are contacted in a cracking zone with a cracking catalyst under cracking conditions to produce a cracked hydrocarbon effluent stream, wherein used cracking catalyst is stripped with a stripping gas for removing hydrocarbons from the cracking catalyst, wherein stripped cracking catalyst is transferred to a regeneration zone in which the cracking catalyst in a dense phase is contacted with a free oxygen containing gas to produce a regenerated catalyst, and wherein regenerator off-gas is removed from a dilute phase on top of the dense phase and wherein regenerated catalyst is transferred to the cracking zone for cracking said hydrocarbons, and wherein there is afterburning in the dilute phase which is maintained at a desired level at a constant flow of stripping gas, the improvement comprising (a) determining the degree of afterburning in the dilute phase and generating a control signal responsive thereto, and (b) controlling the flow of said stripping gas such as to give an immediate change in the degree of afterburning by decreasing the flow of stripping gas when the degree of afterburning is above the desired level and increasing the flow of stripping gas when the degree of afterburning is below the desired level.

2. A process in accordance with claim 1 wherein the temperatures in the dilute phase and in the dense phase are determined and wherein said control signal is generated responsive to the difference of the dilute phase temperature and the dense phase temperature, and wherein the flow rate of stripping gas is decreased when the temperature difference is above said desired value and increased when a temperature difference is below said desired value.

3. A process in accordance with claim 1 wherein said stripping gas is steam.

4. A process according to claim 1 wherein the flow rate of said free oxygen containing gas is maintained at a constant value.

5. A process in accordance with claim 1 wherein said free oxygen containing gas is air.

* * * * *